United States Patent [19]

Lindberg

[11] Patent Number: 4,719,678

[45] Date of Patent: Jan. 19, 1988

[54] METHOD FOR DRAINING A HYDROTHERAPY PUMP

[75] Inventor: Donald Lindberg, North Hollywood, Calif.

[73] Assignee: Albert R. Weaver, Symar, Calif.

[21] Appl. No.: 869,882

[22] Filed: Jun. 3, 1986

Related U.S. Application Data

[60] Continuation of Ser. No. 588,287, Apr. 10, 1984, abandoned, which is a division of Ser. No. 509,383, Jun. 30, 1983, Pat. No. 4,465,428, which is a continuation of Ser. No. 182,123, Aug. 28, 1980, abandoned.

[51] Int. Cl.[4] ..... B21D 53/00

[52] U.S. Cl. ..... 29/157 R; 29/157 A; 29/157.1 R; 29/428; 29/462

[58] Field of Search ..... 29/156.8 R, 157 R, 157 A, 29/157 C, 157 T, 157.1 R, 428, 462; 285/150, 153, 154, 156, 179, 189, 181; 4/191, DIG. 7

[56] References Cited

U.S. PATENT DOCUMENTS

| | | | |
|---|---|---|---|
| 702,125 | 6/1902 | Buckley | 29/463 X |
| 1,140,720 | 5/1915 | Simons | 285/181 X |
| 3,583,003 | 6/1971 | Thompson | 4/191 |
| 4,179,762 | 12/1979 | Barnhardt et al. | 4/191 |
| 4,239,262 | 12/1980 | Krupp et al. | 285/179 X |
| 4,258,742 | 3/1981 | Louthan et al. | 29/157 T X |

FOREIGN PATENT DOCUMENTS

| | | | |
|---|---|---|---|
| 1129049 | 10/1968 | United Kingdom | 285/81 |

*Primary Examiner*—Howard N. Goldberg
*Assistant Examiner*—Ronald S. Wallace

[57] ABSTRACT

A pipe fitting for attachment to a hydrotherapy pump has an inlet and outlet having parallel offset axes, with a separate small hollow nipple extending from and communicating with the inlet. The nipple attaches to the pump at a location normally occupied by the pump freeze plug. The fitting permits complete drainage of the hydrotherapy pump after pump is shut off.

2 Claims, 4 Drawing Figures

METHOD FOR DRAINING A HYDROTHERAPY PUMP

This is a continuation of co-pending application Ser. No. 06/588,287 filed on Apr. 10, 1984, now abandoned, which was a division of application Ser. No. 509,383, filed June 30, 1983 (now U.S. Pat. No. 4,465,428), which in turn was a continuation of application Ser. No. 182,123 filed Aug. 28, 1980, now abandoned.

BACKGROUND OF THE INVENTION

In recent years, hydrotherapy vessels have become popular for both medical and social use. While in the past use of hydrotherapy vessels was generally limited to medical or physical therapy, such as for athletes to relieve pain and increase circulation for muscle injuries, more recently the use of hydrotherapy vessels for social purposes and relaxation has undergone spectacular growth. Units may be located outdoors, either in conjunction with a swimming pool or independently, or may be included as a part of a bathtub which is equipped with water circulating mechanisms. The outdoor units are usually relatively large, holding from about 150 to about 800 gallons of water, and require the addition of chemicals to modify water pH and control bacteria growth. Indoor units, such as bathtubs, are usually sufficiently small to justify a separate filling for each use. Prior to use, these tubs are filled with water from the home hot water supply source, and are drained immediately after the use has been completed.

Hydrotherapy bathtubs are generally molded shells which have jet nozzles located at various points on the interior of the tub. A circulating pump brings water from a location near the tub bottom, generally near the drain, and pumps it through the jets thereby creating desired turbulence. Air intake ports built into the jet permit air to be sucked into the jet in large quantities according to the Bernouilli effect, creating a large volume of fluid flow.

Hydrotherapy pumps used in connection with these tubs are generally small centrifugal pumps having a pump impeller which rotates in a vertical plane, and which have an inlet in the pump casing located in a center portion of the casing and an outlet at the top of the casing. The pump casing defines a relatively narrow disc-shaped chamber in which the pump impeller is mounted.

It is conventional for the hydrotherapy pump to be slightly elevated above the tub drain, with the piping connecting the pump inlet to the drain being slightly inclined to permit excess water in the system to drain back through the pump inlet and out the tub drain when the pump is shut off. However, it has now been found that a small amount of water, generally less than one-half cup, remains in the bottom of the pump casing after use of the pump has ceased. This water is unable to drain from the pump casing because the lowest portion of the pump inlet is located at a point above the bottom of the impeller chamber within the pump casing. For most instances of use of commercially available centrifugal pumps, the existence of a small residue of water after use would not create a problem; an exception, however, is the use of centrifugal pumps in freezing weather, when the pump must be completely drained during protracted periods of non-use. For example, a water supply pump for a mountain cabin could be severely damaged if actuated when ice existed in the casing.

In hydrotherapy tubs, the water retained in these pumps may become a breeding ground for harmful bacteria and molds, and may be a source of unpleasant odors. Since several days or weeks may pass between uses of hydrotherapy tubs, particularly in hotels and motels, the existence of a stagnant residue of water at the bottom of the pump casing may create a health hazard, including the possibility of exposure to communicable diseases, in addition to objectionable odors. The present invention provides a method and a fitting for permitting the removal of substantially all of the water in the pump casing after the hydrotherapy pump is shut off.

Accordingly, it is an object of the present invention to provide a pipe fitting which attaches to the conventional inlet of a hydrotherapy pump and also has a conduit which communicates with an opening at a bottom portion of the impeller chamber. It is another object of the invention to provide a fitting which attaches to the pump inlet and also connects with an opening in the casing in an area normally occupied by the freeze plug of the pump. It is yet a further object of the invention to provide a pipe fitting for attachment to the pump inlet which also provides drain means for permitting drainage of substantially all water remaining in the impeller chamber of a centrifugal pump. These and other objects of the invention are accomplished through the use of the method and device of the invention, a specific embodiment of which is set forth in detail herein.

SUMMARY OF THE INVENTION

A pipe fitting for attachment to a hydrotherapy pump comprises a conduit having inlet and outlet portions having offset axes, fastening means adjacent the fluid outlet for connecting the outlet portion to an intake of a hydrotherapy pump, and a nipple extending from the inlet portion and communicating therewith having a diameter substantially smaller than the inlet portion. Preferably, the fitting provides an S-shaped conduit, and the plane of an opening of the nipple is parallel to or co-planar with the plane of the opening of the outlet portion of the conduit. The invention also contemplates the combination of this fitting with a pump, and an adjustable sealing fitting extending between the nipple and the pump.

BRIEF DESCRIPTION OF THE DRAWINGS

The invention is best understood with reference to the drawings, in which.

DETAILED DESCRIPTION OF THE INVENTION

Figure 1:
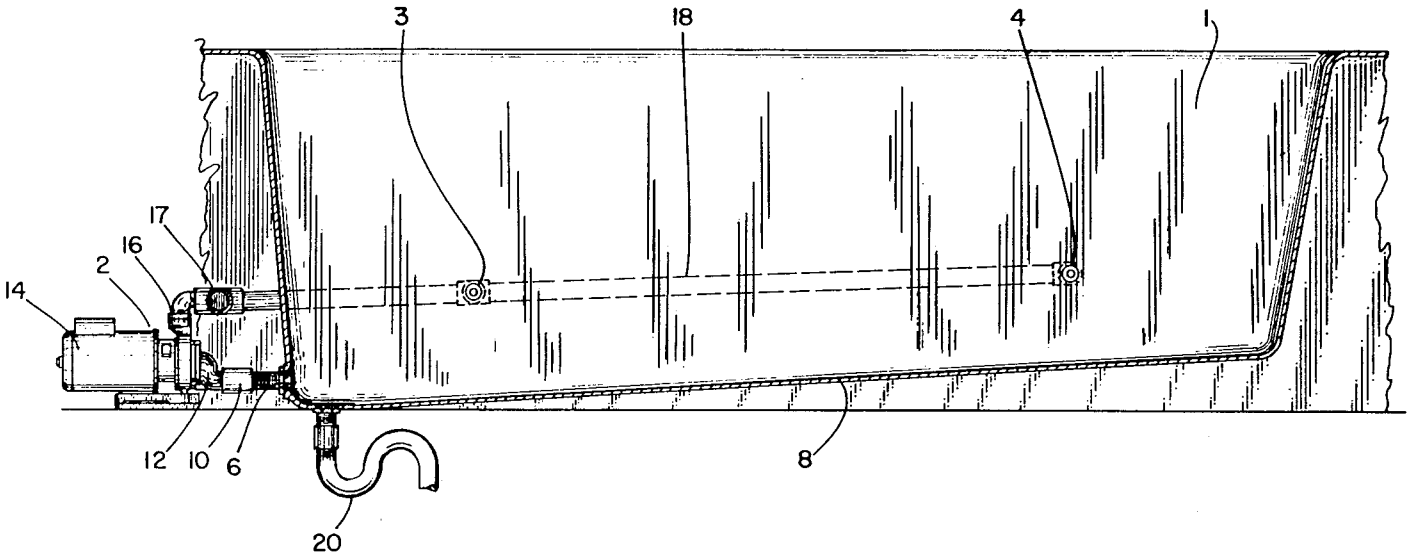
FIG. 1 is a side elevational view, partly in section, of a hydrotherapy tub showing the hydrotherapy pump and the water circulating system, and showing the fitting of the invention mounted on the pump.

Referring to FIG. 1, hydrotherapy tub 1 has water circulated from the tub through centrifugal pump 2 to a series of jets 3 and 4 mounted in the sidewalls of the tub.

Water circulates from a port 6 in a wall of the tub adjacent the tub bottom 8, through an upwardly sloped pipe 10 to the intake of pump 2. Pipe 10 is connected to the pump through the drain fitting 12 of the invention. The centrifugal pump, which is driven by electric motor 14, forces water through the pump exhaust 16 and through appropriate plumbing to the hydrotherapy jets. In the configuration shown in FIG. 1, when the pump is operating, the entire plumbing system is filled with water. When the pump is shut off, water is drained from the tub through drain pipe 20. Water also drains by gravity flow from the jets through conduit 18 (and through a similar conduit not shown, on the other side of the tub and connecting with conduit 18 through tee 17) back to the impeller chamber of pump 2. Water from the chamber drains through the fitting 12 of the invention and pipe 10 (which has a slight downward inclination) to the tub, exiting the tub through the drain 20. Accordingly, when the tub drain is open and the pump is shut off, all of the water in the system will flow to the drain.

Figure 4:
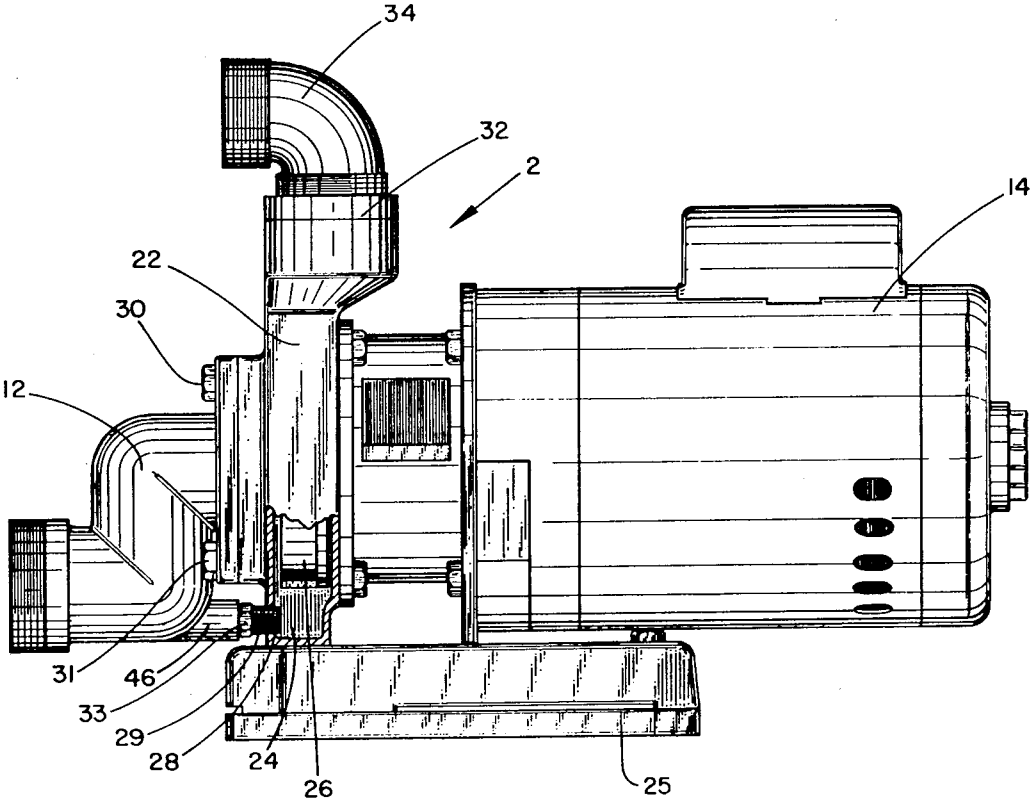
FIG. 4 is a side elevational view of a centrifugal pump with the fitting mounted thereon, and showing a portion of the impeller chamber in section.

A more detailed view of the fitting of the invention attached to the pump is shown in FIG. 4. The pump 2 consists primarily of a base 22 on which is mounted an electric motor 14 which drives a pump impeller (partially shown at 26). The pump impeller is mounted in a substantially disc-shaped vertical chamber 24 defined by pump casing 22. Water travels into the impeller chamber 24 through fitting 12, being propelled upwardly and out through the pump exhaust 32 and elbow fitting 34.

Figure 2:
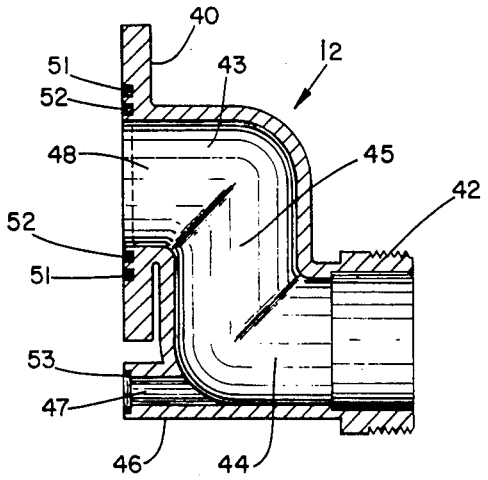
FIG. 2 is a side section view of the fitting of the invention.
Figure 3:
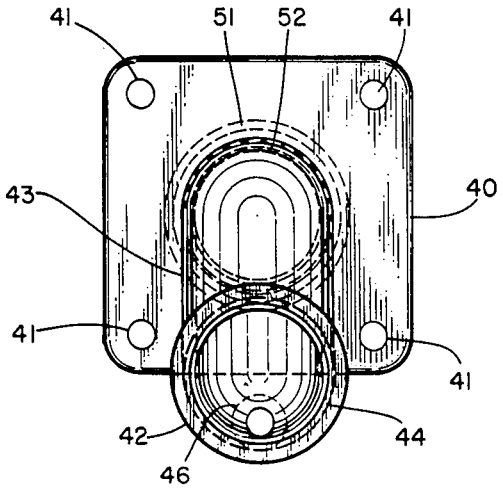
FIG. 3 is an end view of the fitting of the invention.

Details of the fitting of the invention are shown in FIGS. 2 and 3. In its preferred embodiment, the fitting is an S-shaped conduit having a flange 40 having bores 41 therethrough for receiving mounting bolts for fastening the fitting to the pump suction, and a threaded male fitting 42 at the other end for fastening to appropriate pipe fittings. The conduit is round in cross-section, and has two vertically displaced sections 43 and 44 joined by a third section 45 perpendicular to the axes of sections 43 and 44. The sections 43 and 44 preferably have parallel offset axes. A small conduit comprising a hollow nipple 46 which communicates with the interior of the conduit extends along an axis parallel to the axes of sections 43 and 44, with the opening 47 at the end of the nipple being in substantially the same plane as the opening 48 in the flange in the preferred embodiment shown in FIGS. 2 and 3. Concentric O-ring seats 50 and 51 are grooves molded into the face of the flange 40, and an additional O-ring seat 53 is molded to the end of the nipple providing sealing means for the fitting ports. The drain conduit portion of the fitting shown as the nipple may be molded integrally with the fitting, thus not having the appearance of an exteriorly extending seperate member.

Mounting of the fitting of the invention is shown in FIG. 4. In preparing the pump to receive the fitting of the invention, a drain hole must first be generated in the lower portion of the impeller casing directly below the pump suction opening. This hole, shown in FIG. 4 as 28, is approximately ⅜" in diameter and may be drilled by conventional means; however, in most commercially available contrifugal pumps, a freeze plug is located in exactly this position. Therefore, it is necessary only to knock out the freeze plug (or unscrew the plug, if it is a threaded plug) to prepare the pump for receiving the fitting 12. The freeze plug opening is then threaded, if necessary, and fitted with an adapter 29, which is a threaded tubular drain plug fitting having a flat hex head 33. This plug is then threaded into the casing as shown in FIG. 4, and the drain fitting 12 is attached.

The fitting of the invention is attached to the pump suction by means of bolts 30 and 31 which extend through bores 41 in flange 40 and engage threaded bores in the flange of the pump suction. The O-rings form a tight seal between the fitting and the pump suction flange. Next, the hex head of drain fitting 29 is reversed until it abuts the end of nipple 46, with an O-ring seated in groove 53 forming a tight seal between the nipple and the drain plug. Accordingly, when the pump is shut off, all of the water in the impeller chamber 24 will drain out through drain plug 29, through nipple 46, and to the drain.

In some cases, reversing the drain fitting to form a seal with the fitting may cause a leak in the threaded fitting. An alternate method of forming this seal is to insert the drain plug with the face of the plug extending past the plane of the pump flange. Then, the pump flange (which generally has a rough surface), and the face of the drain plug are concurrently milled with a grinder to form coplanar surfaces.

The relative sizes of the main conduit of the fitting and of the nipple are relatively important. The main conduit is substantially larger than the nipple; typically, the internal diameter of the fitting will be about 2", whereas the internal diameter of the nipple is about ⅜". By "substantially larger" is meant a cross-sectional area at least ten times, and preferably at least fifteen times greater than the cross-sectional area of the interior of the nipple. The large diversity in diameters permits adequate and rapid drainage from the impeller chamber as necessary without interfering with the flow characteristics of the pump during normal operation.

Indeed, because the aperture in the drain fitting actually acts as a pump outlet (thus recycling a small amount of fluid through the fitting), the passageway should ideally be only large enough to permit drainage without danger of plugging. This may be accomplished by reducing the internal diameter of the nipple, but may also be achieved by reducing the diameter of the bore through the drain plug to e.g. ⅛".

The fittings of the invention are most easily molded from plastic, such as PVC, but may be cast in metal, such as bronze. Minor modifications in the fitting, such as variations in the method of fastening the fitting to the pump or to auxiliary plumbing, are within the scope of the invention, as are changes in the orientation of the nipple to adapt to various pump designs. Accordingly, the invention should not be considered to be limited to the specific preferred embodiment disclosed herein, but rather should be limited only by the following claims.

I claim:

1. A method of providing substantially complete drainage for an impeller chamber of a hydrotherapy pump having a unitary integral exterior casing, said chamber containing a pump impeller and being defined by walls and having a pump suction inlet and a pump exhaust communicating with the chamber, comprising boring a drain opening in a chamber wall in a bottom portion of the chamber, and sealingly attaching to said opening and to said pump suction two ports of a pipe fitting having at least three ports, said pipe fitting having a mounting flange for attachment directly to the pump casing.

2. The method of claim 1 also comprising inserting plug means having a threaded fitting at one end, a radial face at another end, and an axial bore therethrough, and subsequently milling the plug face to substantially coplanar alignment with a pump inlet flange.

* * * * *